United States Patent [19]

Fukui et al.

[11] Patent Number: 4,894,546

[45] Date of Patent: Jan. 16, 1990

[54] HOLLOW CATHODE ION SOURCES

[75] Inventors: Ryota Fukui, Fujisawa; Kenichi Takagi; Riichi Kikuchi, both of Chigasaki; Kazuo Takayama, Machida; Akira Tonegawa, Hatano, all of Japan

[73] Assignee: Nihon Shinku Gijutsu Kabushiki Kaisha, Kanagawa, Japan

[21] Appl. No.: 164,803

[22] Filed: Mar. 7, 1988

[30] Foreign Application Priority Data

Mar. 11, 1987 [JP] Japan ..... 62-54110
Feb. 3, 1988 [JP] Japan ..... 63-22065

[51] Int. Cl.[4] ..... H01J 27/00

[52] U.S. Cl. ..... 250/423 R; 250/426; 313/359.1; 315/111.81

[58] Field of Search ..... 250/432 R, 426; 315/111.81, 111.91; 313/230, 359.1, 360.1, 361.1, 362.1, 363.1

[56] References Cited

U.S. PATENT DOCUMENTS 2,501,882 3/1950 Trump et al. ..... 313/360.1
2,770,755 11/1956 Good ..... 313/361.1
3,944,873 3/1976 Franks et al. ..... 250/423 R
4,475,063 10/1984 Aston ..... 315/111.81
4,641,031 2/1987 Ito et al. ..... 250/423 R
4,749,912 6/1988 Hara et al. ..... 313/362.1

*Primary Examiner*—Bruce C. Anderson
*Attorney, Agent, or Firm*—Hugh Adam Kirk

[57] ABSTRACT

A hollow cathode ion source for in a vacuum chamber wherein it comprises a cylindrical cathode through one end of which a gaseous medium of at least a discharge maintaining gas or said discharge maintaining gas and a metal vapor is or are introduced, and an anode provided on the other end of said cylindrical cathode and having at least one ion extraction opening, said gaseous medium being ionized by a discharge means between said cylindrical cathode and said anode to produce ions which are extracted through said ion extraction opening in the axial direction of said cylindrical cathode.

The cylindrical cathode in the ion source has a large diameter at least about half and preferably about equal to its axial length and may be directly cooled.

12 Claims, 3 Drawing Sheets

HOLLOW CATHODE ION SOURCES

FIELD OF THE INVENTION

This invention relates to a hollow cathode ion source which may be used in a plasma processing, an ion implantation or an analysis.

BACKGROUND OF THE INVENTION

Generally, it is known that a hollow cathode ion source for in a vacuum chamber has features that its electrode structure is simple, a plasma having relatively high density is produced, and the operation is stable for a long time, thereby obtaining stable ion beams. Various type hollow cathode ion sources have been proposed. For example, Japanese Patent Kokai No. 62-73542 discloses a hollow cathode ion source of a cold cathode type which comprises a cylindrical discharge chamber having major portion formed as a cathode, anodes attached to the cathode electrode via an electrically insulating member, an inlet for a discharge maintaining gas provided on the cylindrical side of the discharge chamber, an ion extraction opening provided on the cathode portion of the opposite side of the cylindrical discharge chamber, and means for cooling the cathode portion of the cylindrical discharge chamber. A sample gas (or metal vapor) is introduced through the gas inlet into the cylindrical discharge chamber and is ionized by a discharge between the anodes and the cathode to produce desired ions. The produced ions are extracted through the ion extraction opening in a direction perpendicular to the axial line of the cathode. By feeding a coolant such as pure water or the like to the cooling means, the sputtering of the cathode material may be accelerated.

In the hollow cathode ion source of this type, however, since the ion extraction opening is provided on the cylindrical cathode portion of the cylindrical discharge chamber, there can not be obtained an ion beam having a circular cross section of a considerably large diameter. Further, the ions are accelerated near the cathode to cause the ion beam having irregular energy to be naturally projected through the extraction opening on the cathode and therefore some drawbacks may be involved when the ion beam is to be used for an analysis.

In Japanese patent application No. 278767/86 we, the inventors, have proposed a hollow cathode ion source in which an ion extraction slit and an opening for introducing a carrier gas are respectively provided on the front and back surfaces of a cylindrical hollow cathode, an extraction electrode is disposed in front of the ion extraction slit, a floating electrode is interposed between the ion extraction slit and the extraction electrode and is provided with a slit aligned with the ion extraction slit, and an anode is interposed between the floating electrode and the extraction electrode and is provided with a slit communicating with the slit of the floating electrode. Argon gas or other carrier gas is introduced through the opening into the cylindrical hollow cathode. The introduced carrier gas is passed through the ion extraction slit and the slits of the floating electrode and the anode, and a discharge is generated in those slits by applying a suitable discharging voltage thereto, thereby forming a plasma of relatively high density in the slits.

The previously proposed hollow cathode ion source has drawbacks that a discharge may readily occur between the extraction electrode and the anode when the degree of vacuum in the cylindrical hollow cathode is insufficient, and thus it is impossible to apply a higher voltage to the extraction portion. In order to improve the degree of vacuum in the cylindrical hollow cathode to be able to apply the higher voltage to the extraction portion, it is necessary to reduce the quantity of the gas to be introduced into the cylindrical hollow cathode. However, if the quantity of the gas to be introduced is reduced, the gas pressure in the cylindrical hollow cathode decreases and then the mean free path of electrons is lengthened. Therefore, the probability that the electrons arrive at the surface of the cylindrical hollow cathode is higher than the probability that the electrons collide with the gas and metal atoms. As a result, the reduction of the gas quantity makes it difficult to maintain the discharge in the cylindrical hollow cathode. Thus, the previously proposed hollow cathode ion source has not provided sufficient gas efficiency.

It is, therefore, an object of this invention to provide a hollow cathode ion source in which the drawbacks of the above-mentioned conventional ion source can be overcome and an ion beam having a circular cross section and a uniform energy can be obtained with better efficiency.

Another object of this invention is to provide a hollow cathode ion source which can maintain a higher discharging voltage and provide a high ionization rate.

Still another object of this invention is to provide a hollow cathode ion source which is provided with multi-stage floating electrode for enhancing a plasma density.

A further object of this invention is to provide a hollow cathode ion source which is provided with means for increasing a sputtering rate and converging the plasma in a discharging path.

SUMMARY OF THE INVENTION

According to a first aspect of this invention, there is provided a hollow cathode ion source for in a vacuum chamber comprising a cylindrical cathode, a first anode provided on one end of said cylindrical cathode and having an ion extraction opening, a second anode provided on the other end of said cylindrical cathode and having at least one opening for introducing a gaseous medium such as a sample gas and optionally a metal vapor into said cylindrical cathode. Said gas or said gas and metal vapor introduced through said opening is ionized by a discharge means between said cylindrical cathode and said first and second anodes to produce ions which are extracted through said ion extraction opening in the axial direction of said cylindrical cathode.

The size of the ion extraction opening on the first anode may vary in diameter up to the size of the inner diameter of the cylindrical cathode, and the ion extraction opening may comprise a single or a plurality of apertures.

According to a second aspect of this invention, there is provided: (a) a hollow cathode ion source comprising a hollow cathode body having large diameter substantially equal to the axial length of its cylindrical cathode through one end of which a gaseous medium, comprising at least a discharge maintaining gas or said discharge maintaining gas and a metal vapor, is or are introduced to produce ions by a discharging; (b) an anode provided on the other end of said hollow cathode body via an insulator and having ion extraction opening for extracting the ions produced in said hollow cathode body in the axial direction of said hollow cathode body; and (c) means provided at the periphery of said hollow cathode body for cooling said hollow cathode body.

The surface area and hence the diameter of the hollow cathode body may be selected to be able to maintain the discharging even if the gas quantity to be introduced therein is reduced. By increasing the surface area or diameter of the hollow cathode body, electron emission amount from the surface of the hollow cathode body may be increased to readily maintain the discharge. The quantity of metal atoms may also be increased by the increase in the surface area or diameter of the hollow cathode body, thereby resulting in an increase in the metal ions.

The increase in temperature of the hollow cathode body may be suppressed by directly cooling it, and then a high discharging voltage necessary for cathode sputtering can be maintained.

According to a third aspect of this invention, there is provided: (a) a hollow cylinder cathode ion source comprising a hollow cathode body having large diameter about equal to the axial length of the cylindrical cathode through one end of which a gaseous medium, comprising at least a discharge maintaining gas or said discharge maintaining gas and a metal vapor, is or are introduced to produce ions by a discharging; (b) an anode provided on the other end of said hollow cathode body via multi-stage insulator and having ion extraction opening for extracting the ions produced in said hollow cathode body in the axial direction of said hollow cathode body; (c) means provided at the periphery of said hollow cathode body for cooling said hollow cathode body; (d) multi-stage floating electrode arranged between the adjacent insulators of said multi-stage insulator and having an ion passage for guiding the produced ions from said hollow cathode body to the ion extraction opening of said anode along the axial direction of said hollow cathode body and floating between the other end of said hollow cathode body and said anode.

The multi-stage floating electrode may be operated to limit the flow of the discharge maintaining gas in the extraction portion and to converge the plasma at the portion of the anode and the multi-stage floating electrode, thereby enhancing the plasma ionization to increase the ionization rate.

According to a fourth aspect of this invention, there is provided: (a) a hollow cathode ion source comprising a hollow cathode body having large diameter about equal to the axial length of the cylindrical cathode through one end of which at least a discharge maintaining gas or said discharge maintaining gas and a metal vapor is or are introduced to produce ions by a discharging; (b) an anode provided on the other end of said hollow cathode body via multi-stage insulator and having ion extraction opening for extracting the ions produced in said hollow cathode body in the axial direction of said hollow cathode body; (c) means provided at the periphery of said hollow cathode body for cooling said hollow cathode body; (d) multi-stage floating electrode arranged between the adjacent insulators of said multi-stage insulator and having an ion passage for guiding the ions from said hollow cathode body to the ion extraction opening of said anode along the axial direction of said hollow cathode body and floating between the other end of said hollow cathode body and said anode; and (e) means for applying a magnetic field to an assembly of said hollow cathode body, said anode and said multi-stage floating electrode in the axial direction of said hollow cathode body.

By applying the external magnetic field, the plasma in the discharge path may be more strongly converged, thereby resulting in an increase of the ionization rate.

BRIEF DESCRIPTION OF THE DRAWINGS

In order that this invention may be more clearly understood, it will now be disclosed in greater detail with reference to the accompanying drawings, wherein.

DETAILED DESCRIPTION OF THE INVENTION

Figure 1:
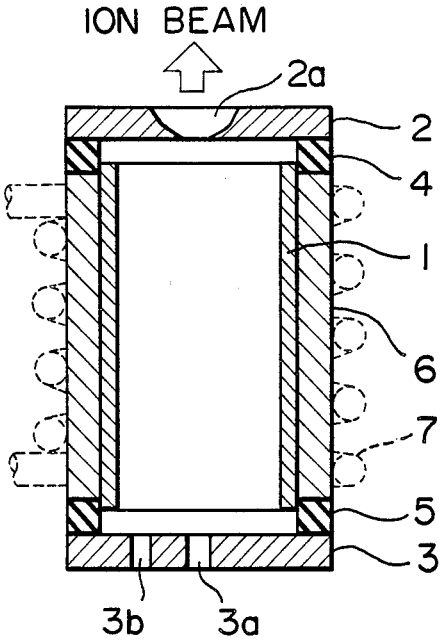
FIG. 1 is a longitudinal sectional view showing schematically the principle of a hollow cathode ion source according to this invention.

Referring to FIG. 1 of the drawings wherein the principle of a hollow cathode ion source for a vacuum chamber (not shown), numeral 1 designates a cylindrical cathode having upper and lower ends on which an upper and lower circular anodes 2 and 3 are provided via annular electrical insulators 4 and 5, respectively. The upper circular anodes 2 is provided with an ion extraction opening 2*a* at substantially the center thereof, and the lower circular anode 3 is provided with a metal vapor inlet 3*a* and a sample gas inlet 3*b*. To the outer periphery of the cylindrical hollow cathode 1 is attached a cylindrical heat shield 6 for supporting the cylindrical hollow cathode 1. In a cold cathode type, the cylindrical heat shield or heat sink 6 and the cylindrical hollow cathode 1 may be cooled by providing a cooling pipe 7 for circulating coolant such as pure water or the like around the heat shield 6 as designated by broken lines in FIG. 1.

Gas introduced through the gas inlet 3*b* or this gas and metal vapor introduced through the metal vapor inlet 3*a* is or are ionized by a discharge which occurs between the hollow cathode 1 and each of the upper and lower circular anodes 2 and 3. The ions thus produced are extracted through the ion extraction opening 2*a* of the upper circular anode 2.

In this ion source, the ion extraction opening 2*a* is provided on the upper circular anode 2 to extract the ions in the axial direction of the cylindrical hollow cathode 1. Thus, the diameter of the ion extraction opening 2*a* can vary in size or diameter up to the size of the inner diameter of the cylindrical hollow cathode 1 as a maximum, and the extracted ion beam has a uniform energy density.

Figure 2:
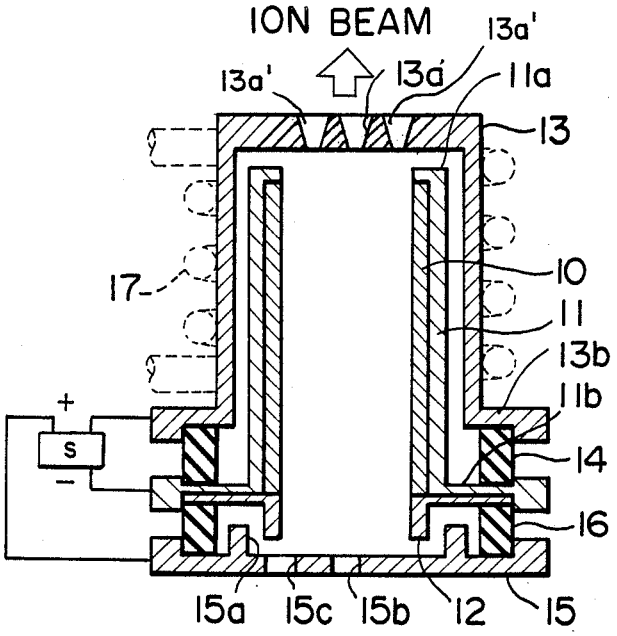
FIG. 2 is a longitudinal sectional view schematically showing an embodiment of this invention.

In FIG. 2 there is illustrated a hollow cathode ion source according to an embodiment of this invention. The illustrated ion source comprises a cylindrical hollow cathode 10 which is supported by a cylindrical cathode shield 11 attached to the outer periphery thereof. The cathode shield 11 has a edge portion 11*a* engaged with the upper end of the hollow cathode 10 and a flange 11*b* positioned substantially in the same level as the lower end of the hollow cathode 10. The hollow cathode 10 and the cathode shield 11 are supported on a supporting member 12.

An upper anode 13 having a diameter larger than that of the cathode shield 11 is of a cylindrical cap-like, and is provided with an ion extraction opening 13*a* at the center of the upper end wall and a flange 13*b* at the lower end. The upper anode 13 is supported on the flange 11*b* of the cathode shield 11 via an annular insulator 14.

A disk-like lower anode 15 has an annular projection 15*a* on its upper surface to increase the anode's effectiveness, a metal vapor inlet 15*b* at the center, and a sample gas inlet 15*c* formed at a position displaced slightly from the center. The lower anode 15 supports the supporting member 12, the cathode 10, the cathode shield 11 and the upper anode 13 via an annular insulator 16.

In the illustrated hollow cathode ion source, the gas and optionally metal vapor are introduced through the gas inlet 15*c* and the metal vapor inlet 15*b* on the lower anode 15 into the hollow cathode 10, and is ionized by a discharge which occurs between a cathode assembly of the cathode 10, cathode shield 11 and the supporting member 12, and each of the upper and lower anodes 13 and 15 to produce the ions which are extracted through the ion extraction opening 13*a* on the upper anode 13 in the axial direction of the hollow cathode 10. If desired, a plurality of ion extraction openings 13*a' may be provided in the anode 13.*

When used as a cold cathode type, coolant such as pure water or the like is fed into the pipe 17 (shown in broken lines) wound around the upper anode 13 to cool it and the cathode 10 is cooled by means of heat radiation. In this case, when the cathode 10 and the cathode shield 11 are made of metal containing a required ion seed such as Mo, W, Ni and the like, ion atoms of the metal are fed into the the ion source by sputtering, and are ionized by the discharge means 5 between the cathode assembly of the cathode 10, cathode shield 11 and the supporting member 12, and each of the upper and lower anodes 13 and 15.

Figure 3:
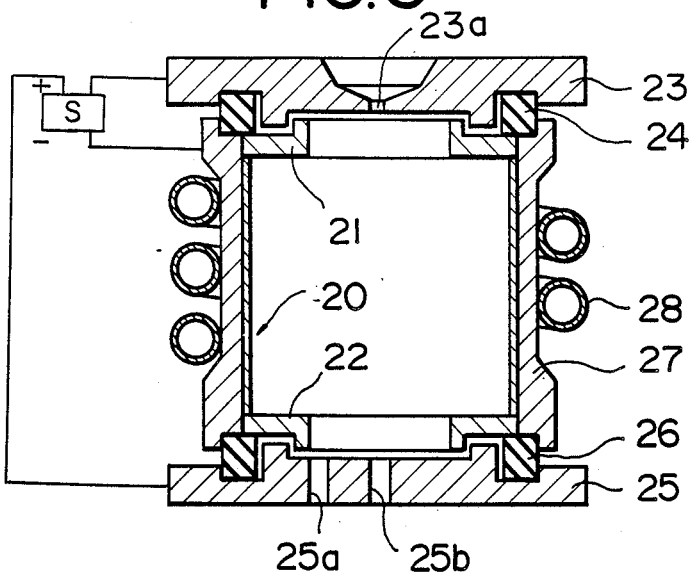
FIG. 3 is a longitudinal sectional view schematically showing another embodiment of this invention.

FIG. 3 schematically shows a hollow cathode ion source according to another embodiment of this invention. Reference numeral 20 designates a hollow cathode body which is made of nickel, molybdenum, tungsten and the like. Upper and lower flanges 21 and 22 made of the same material as the hollow cathode body 20 are integrally provided at the upper and lower ends of the hollow cathode body 20 to form a part of the cathode.

On the upper flange 21 is provided a circular upper anode 23 via an annular insulator 24. This upper anode 23 is provided with an ion extraction opening 23*a* at a position substantially through the center thereof, i.e., the axis of the hollow cathode body 20.

On the lower flange 22 is provided a circular lower anode 25 via an annular insulator 26. The lower anode 25 is provided with a discharge maintaining gas inlet 25*a* and a metal vapor inlet 25*b* as shown in FIG. 3. A cylindrical shield member 27 is mounted on the outer periphery of the hollow cathode body 20, and is surrounded by a cooling pipe 28 for circulating coolant such as pure water or the like.

In the operation of the illustrated ion source as described above, discharge maintaining gas such as argon gas or the like and metal vapor (for example Na) to be ionized are introduced into the hollow cathode body 20 through the gas inlet 25*a* and the metal vapor inlet 25*b*, respectively. A suitable discharge voltage is applied between the hollow cathode body 20 and each of the upper and lower anodes 23 and 25 so as to start the discharge in the hollow cathode body 20. Thus, the introduced metal vapor and gas are ionized by the discharge means 5 between the hollow cathode body 20 and each of the upper and lower anodes 23 and 25. In this case, in order to maintain the high discharge voltage by improving the degree of vacuum in the hollow cathode body 20, the quantity of the metal vapor to be introduced through the metal vapor inlet 25*b* is relatively reduced. Therefore the mean free pass of electrons is lengthened to increase the probability that the electrons do not collide with the gas and the metal element but arrive at the surface of the cathode body 20. However, but due to the large diameter of the hollow cathode body 20 about equal to its length, the electrons have a tendency to collide with the gas and the metal element before arriving at the surface of the cathode body 20, thereby maintaining the discharge. The metal ions thus produced are extracted through the ion extraction opening 23*a* in the upper anode 23.

In the embodiment of FIG. 3, it should be understood that since the metal by which the hollow cathode body 20 is formed is sputtered and ionized, it preferably should be constructed by the same metal as the metal vapor to be introduced through the metal vapor inlet 25*b*.

Figure 4:
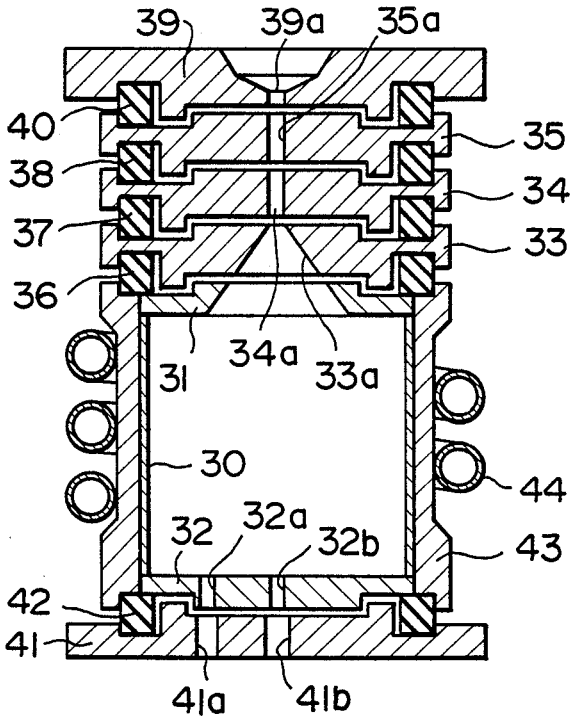
FIG. 4 is a longitudinal sectional view schematically showing still another embodiment of this invention.

FIG. 4 shows a hollow cathode ion source according to still another embodiment of this invention. This hollow cathode ion source comprises a hollow cathode body 30 which is made of nickel, molybdenum, tungsten and the like. The hollow cathode body 30 has a flange 31 made of the same material as the hollow cathode body 30 at the upper end thereof, and is closed at the lower end by a terminal plate 32 which is also made of the same material as the hollow cathode body 30. The terminal plate 32 is provided with a discharge maintaining gas inlet 32*a* and a metal vapor inlet 32*b*.

On the flange 31 of the cathode body 30 are provided three upper floating electrodes 33, 34 and 35 spaced and supported by annular insulators 36, 37 and 38. The floating electrode 33 disposed directly above the flange 31 has a tapered or convergent opening 33*a* extending along the inner inclined edge of the flange 31 as shown in FIG. 4, and the other two floating electrodes 34 and 35 have openings 34*a* and 35*a* coaxial with the convergent opening 33*a* of the floating electrode 33.

An anode 39 is provided on the uppermost floating electrode 35 via an annular insulator 40, and has an ion extraction opening 39*a* substantially at the center. The ion extraction opening 39*a* communicates with the interior of the hollow cathode body 30 through the respective openings 33*a*, 34*a* and 35*a* of the floating electrodes 33, 34 and 35.

A lower electrically floating electrode 41 is mounted on the cathode terminal plate 32 via an annular insulator 42, and is provided with openings 41*a* and 41*b* which communicate with the gas inlet 32*a* and the metal vapor inlet 32*b*, respectively.

To the outer periphery of the hollow cathode body 30 is attached a cylindrical shield member 43 similarly to the case of the embodiment in FIG. 3, and a cooling pipe 44 for circulating coolant such as pure water or the like is helically wound on the shield member 43.

The operation of the ion source illustrated in FIG. 4 will now be described.

Carrier gas such as argon gas or the like and metal vapor to be ionized are introduced into the hollow cathode body 30 through the openings 41*a* and 41*b* of the lower electrode 41, and the gas inlet 32*a* and the metal vapor inlet 32*b*, respectively. The discharge is commenced by initially setting the upper floating electrodes 33, 34 and 35 and the upper anode 39 to the same potential and then applying a voltage between the hollow cathode body 30 and the upper anode 39. Then, the connections of each of the upper floating electrodes 33, 34 and 35 and the upper anode 39 are disconnected sequentially from the side of the hollow cathode body 30. When all the upper floating electrodes 33, 34 and 35 are disconnected from the upper anode 39, the discharge is established between the hollow cathode body 30 and the inner surface of the ion extraction opening 39*a* in the upper anode 39. The produced plasma now flows naturally out through the openings of the floating electrodes 33, 34 and 35 due to the difference between the external pressure and the inner pressure of the hollow cathode body 30. In this connection, since the openings of the floating electrodes are fine or narrow, the gas scarcely flows through those openings so that a high plasma density can be obtained. Thus, the ionization rate may be improved to obtain a dense ion beam.

Figure 5:
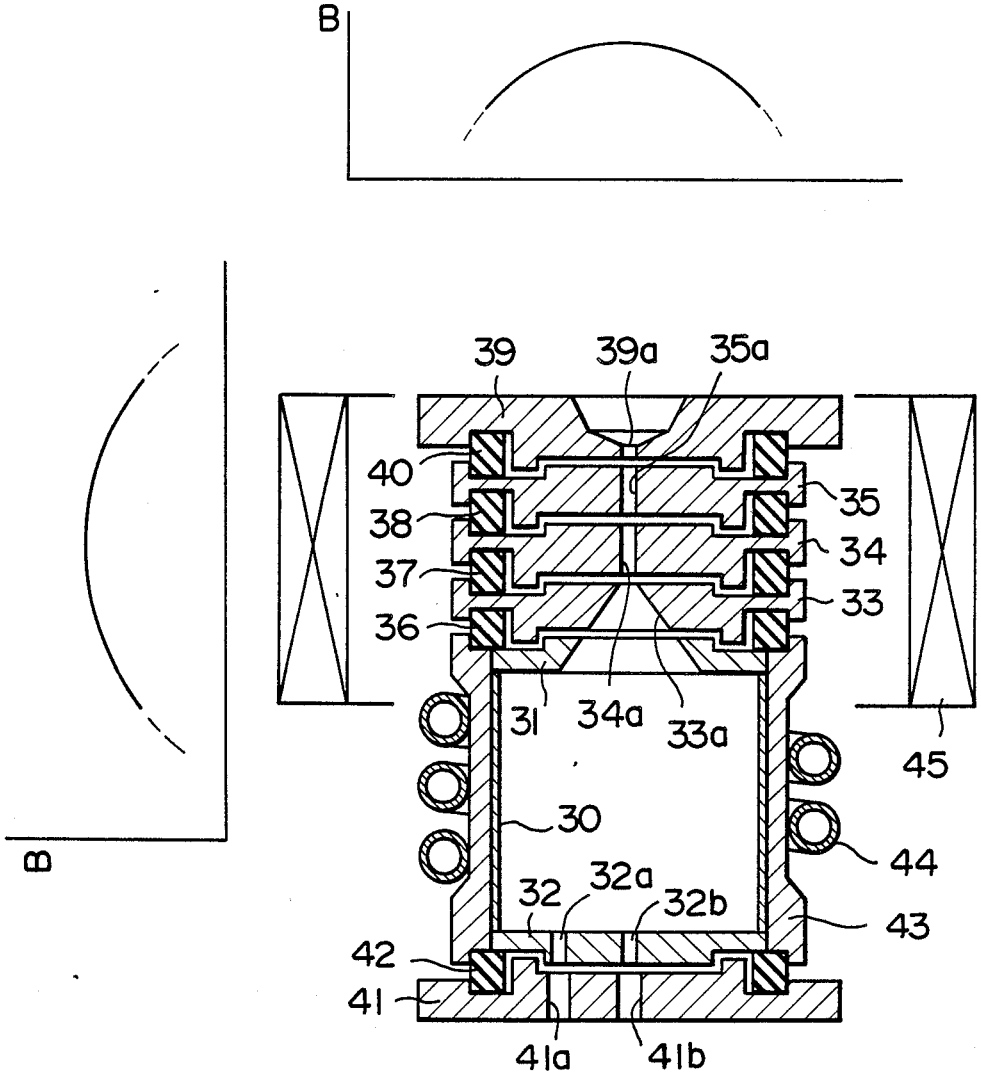
FIG. 5 is a longitudinal sectional view schematically showing a further embodiment of this invention.

FIG. 5 shows a further embodiment of this invention in which the ionization rate can be further improved by applying a magnetic field to the ion source of FIG. 4. The same components as those in the ion source of FIG. 4 are designated by the same reference numerals as those in FIG. 4.

In the embodiment in FIG. 5, on the outside of the assembly of the hollow cathode body 30, the upper floating electrodes 33, 34 and 35 and the upper anode 39 is provided means 45 for applying the magnetic field thereto in the direction of the extraction of the ions. The magnetic field applying means 45 may be formed of a suitable electromagnet assembly or a permanent magnet assembly. The magnetic flux density of the applied magnetic field is enhanced along the openings of the upper floating electrodes 33, 34 and 35 as shown in graphs B at the upper and left sides in FIG. 5. Thus, the discharge voltage may be raised so that the sputtering rate is increased and the plasma in the discharge path is converged, thereby further increasing the ionization rate.

In the embodiments shown in FIGS. 4 and 5, three floating electrodes have been used as the multi-stage floating electrode. It should be appreciated however, that the number of the floating electrodes can be arbitrarily varied as required. Further, although the openings in the floating electrodes and the ion extraction opening are circular in the sectional shape they may be formed in any other sectional shape in accordance with the object for their use.

In the embodiment shown in FIG. 3, the hollow cathode body is provided with the anodes at the both sides thereof. However, it should be understood that, as in the embodiments in FIGS. 4 and 5, the anode may be provided only at the upper side of the hollow cathode body.

According to this invention as described above, since the ion extraction opening is provided on the upper anode, the diameter of the ion beam to be extracted can be selected according to the size or diameter of the extraction opening up to the size of the inner diameter of the hollow cathode. Also a single ion extraction opening or plurality of ion extraction openings can be provided in the extraction anode.

Since the extraction of the produced ions is performed through the anode, a beam having a uniform energy density can be obtained to be used not only for an analysis but also for any other application.

With the use of the hollow cathode having a large diameter and the direct cooling of the hollow cathode, even if the quantity of the gas to be introduced is reduced, the discharge can be maintained, the raising of the temperature of the hollow cathode can be effectively suppressed, and the degree of vacuum in the ion source can be improved. Thus the high discharging voltage required for cathode sputtering can be easily maintained and a high extraction voltage can be applied to the ion extraction portion.

By the provision of the multi-stage floating electrode interposed between the hollow cathode and the anode, the flow of the gas in the extraction portion can be limited. Also the plasma ionization can be enhanced by the discharge at the anode and the multi-stage floating electrode, thereby increasing the ionization rate and obtaining a dense ion beam.

Further, with the provision of the magnetic field applying means, the discharge voltage can be raised so that the sputtering rate can be increased and the plasma in the discharge path can be effectively converged.

The embodiments of this invention described herein are for purposes of illustration and the scope of this invention is intended to be limited only by the following claims.

What is claimed is:

1. A hollow cathode ion source comprising a cylindrical cathode having a diameter at least about half its length, a first anode provided on one end of said cylindrical cathode and having an ion extraction opening, a second anode provided on the other end of said cylindrical cathode and having at least one opening for introducing a gaseous medium, a discharge means between said cylindrical cathode and each of said first and second anodes to ionize said gaseous medium to produce ions which are extracted through said ion extraction opening in the axial direction of said cylindrical cathode, and means for cooling said cathode.

2. A hollow cathode ion source as claimed in claim 1, wherein said ion extraction opening is of multi-aperture type.

3. A hollow cathode ion source as claimed in claim 1, wherein said cooling means cools both said first anode and said cylindrical cathode by means for circulating a coolant around them.

4. A hollow cathode ion source as claimed in claim 1 wherein said second anode has a second opening for introducing a metal vapor into said cylindrical cathode and ionizing said vapor by said discharge means.

5. A hollow cathode ion source comprising a hollow cathode body having a diameter at least about half its length through one end of which body a discharge maintaining gaseous medium to be ionized is introduced, a discharging means to ionize said gaseous medium to produce ions, an anode provided on the other end of said hollow cathode body, and having an ion extraction opening for extracting the ions produced in said hollow cathode body in the axial direction of said hollow cathode body, an electrical insulator between said anode and said cathode, and means provided at the periphery of said hollow cathode body for cooling said hollow cathode body.

6. A hollow cathode ion source as claimed in claim 5, wherein said hollow cathode body is provided with a second anode at said one end of said body, and electrically insulated means between said second anode and said cathode body.

7. A hollow cathode ion source as claimed in claim 6 wherein said discharge maintaining gaseous medium comprises a gas and a metal vapor, and said second anode has separate inlets for said gas and said vapor.

8. A hollow cathode ion source as claimed in claim 5 wherein said discharge maintaining gaseous medium also includes a metal vapor.

9. A hollow cathode ion source comprising a hollow cathode body having a diameter at least about half its length through one end of which body at least a discharge maintaining gaseous medium to be ionized is introduced, a discharging means to ionize said gaseous medium to produce ions, an anode provided on the other end of said hollow cathode body and having an ion extraction opening for extracting the ions produced in said hollow cathode body in the axial direction of said hollow cathode body, an electrical multi-stage insulator between said anode and said cathode, means provided at the periphery of said hollow cathode body for cooling said hollow cathode body, and a multi-stage floating electrode arranged between the adjacent insulators of said multi-stage insulator and having an ion passage for guiding and increasing the density of the ions from said hollow cathode body to the ion extraction opening of said anode along the axial direction of said hollow cathode body.

10. A hollow cathode ion source as claimed in claim 9 wherein said discharge maintaining gaseous medium also includes a metal vapor.

11. A hollow cathode ion source comprising a hollow cathode body having a diameter at least about half its length through one end of which body a discharging maintaining gaseous medium is introduced, a discharging means to ionize the said gaseous medium to produce ions, an anode provided on the other end of said hollow cathode body and having an ion extraction opening for extracting the ions produced in said hollow cathode body in the axial direction of said hollow cathode body, an electrical multi-stage insulator between said anode and said cathode, means provided at the periphery of said hollow cathode body for cooling said hollow cathode body, a multi-stage floating electrode arranged between the adjacent insulators of said multi-stage insulator and having an ion passage for guiding and increasing the density of the ions from said hollow cathode body to the ion extraction opening of said anode along the axial direction of said hollow cathode body, and means for applying a magnetic field to the assembly of said hollow cathode body, said anode and said multi-stage floating electrode in the axial direction of said hollow cathode body.

12. A hollow cathode ion source as claimed in claim 11 wherein said discharge maintaining gaseous medium also includes a metal vapor.

* * * * *